US007686703B2

(12) United States Patent
Kawashima et al.

(10) Patent No.: US 7,686,703 B2
(45) Date of Patent: Mar. 30, 2010

(54) PRACTICE DEVICE FOR CORRECTED GOLF SWING

(75) Inventors: Haruo Kawashima, Tokyo (JP); Nobuyuki Abe, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 11/677,760

(22) Filed: Feb. 22, 2007

(65) Prior Publication Data

US 2007/0249429 A1 Oct. 25, 2007

(30) Foreign Application Priority Data

Feb. 23, 2006 (JP) ..... 2006-047572

(51) Int. Cl.
*A63B 69/36* (2006.01)

(52) U.S. Cl. ..... 473/261; 473/257

(58) Field of Classification Search ..... 473/218, 473/257, 261, 262, 264, 265, 270, 272, 273
See application file for complete search history.

(56) References Cited

U.S. PATENT DOCUMENTS 2,150,580 A * 3/1939 Crowley ..... 473/273
4,230,319 A * 10/1980 Lindner ..... 473/265
4,423,875 A * 1/1984 Miller ..... 473/265
5,139,263 A * 8/1992 Feo ..... 473/218
5,350,177 A * 9/1994 Furbush, Jr. ..... 473/218
5,984,801 A * 11/1999 Mason ..... 473/270
6,443,852 B1 * 9/2002 Kim ..... 473/265

FOREIGN PATENT DOCUMENTS

JP 3076896 4/2001

* cited by examiner

*Primary Examiner*—Nini Legesse
(74) *Attorney, Agent, or Firm*—Brinks, Hofer, Gilson & Lione

(57) ABSTRACT

A practice device for corrected golf swing basically comprises a frame which is relatively long in one direction and a pair of strip-shaped members extending in alignment with each other in the one direction so as to define a straight target line. The frame includes a pair of space defining members extending in the one direction in parallel to each other leaving a space therebetween so that said space is adjustable. The strip-shaped members linearly extend outward in the one direction from respective middle locations on the lines connecting respective pairs of the frame ends which are opposed in a direction orthogonal to said one direction, respectively.

14 Claims, 4 Drawing Sheets

PRACTICE DEVICE FOR CORRECTED GOLF SWING

BACKGROUND OF THE INVENTION

The present invention relates to a practice device for corrected golf swing.

Correct club swing is a basic requirement for a golf player. It is most important in playing golf to make sure of a correct impact zone, to move a club-head linearly to a target and to keep a face of the club-head square to a target line.

In order to improve a sense of golf swing as have been described above, a pair of umbrellas have sometimes been utilized as a means for golf swing practice, as illustrated in FIG. 5 of the accompanying drawings as prior art. With such a practice means, a golf ball is set at the middle of the space defined between these paired umbrellas placed on the ground surface (or the floor surface) so as to extend in parallel to each other, then a player strikes the golf ball for the swing practice with a driver or an iron club with a stance outside one of these umbrellas substantially at the middle of this umbrella. During such practice, if the club-head comes in contact with any one of the umbrellas, the parallelism of the paired umbrellas will be disturbed. On the basis of such disturbance of the parallelism, the player may recognize, although uncertainly, that a trajectory of the club-head has not been in linear alignment with the target line, i.e., whether the swing has described a trajectory of "inside out" or "outside in" or whether the swing has been "cut shot" or not.

Japanese Utility Model Publication No. 3076896 discloses a practice device for corrected putter stroke. This known practice device comprises a bottom plate, a pair of guide walls extending in parallel and opposed to each other along opposite sides of the bottom plate, a putter guide unit having a golf ball positioning depression formed on the bottom plate at a transversely middle position on one end thereof, a putter provided with a guide roller so that the putter may be inserted into a space defined between the paired guide walls and the roller may roll on at least one of the guide walls, and an immobilizing means adapted to immobilize the putter guide unit having been installed on the floor surface. In the case of this practice device, the putter may be moved within the putter guide unit so as to hit the golf ball in the golf ball positioning depression. So far as the putter moves in parallel to the guide walls, the putter will correctly hit the golf ball and the player will be free from any feeling of resistance and/or incompatibility due to a pressure of the putter against the associated one of the guide walls in the course of the putter's stroke. However, if the putter's stroke is not parallel to the associated guide wall, a feeling of resistance and/or incompatibility will be transmitted to the player's hands, making the player aware of incorrectness of his or her putter stroke.

In the case of the prior art as has been described above in the course of swinging, if the club-head comes in contact with any one of the paired umbrellas, the initial parallelism between them will be disturbed or the umbrella(s) will be damaged by an impact power. It will be bothersome to reset the paired umbrellas. In addition, if the swing practice is continued with the paired umbrellas left in the disturbed placement, it will be impossible for the player to make sure of a correct impact zone and/or to become aware of a correct swing. Thus, the desired effect of the practice can not be obtained.

The practice device disclosed by the prior art is for correct putter's stroke and therefore this device is not useful for swing practice with the clubs other than the putter such as an iron and a driver as well as for approach practice with a wedge.

SUMMARY OF THE INVENTION

An object of the present invention is to solve the problem as has been described above.

Specifically, it is an object of the present invention to provide a practice device for corrected golf swing adapted to improve of skill requirements for a golf player, that is, "on plane swing", "face control" and "linear impact zone."

It is another object of the present invention to provide a practice device for corrected golf swing which is relatively bulky in its assembled state but allows for compact storage, for example, in a bag for shipping or carrying.

The other objects of the present invention will become apparent in the light of the description given hereafter.

According to the present invention, there is provided a practice device for corrected golf swing having a first direction and a second direction orthogonal to the first direction comprises: a frame which is relatively long in the first direction and first and second strip-shaped members aligned with each other so as to form a target line extending straight in the first direction, the frame which includes first and second space defining members which extend in parallel to each other in the first direction, leaving an adjustable space therebetween, and the first and second strip-shaped members respectively extending straight in the first direction outward from middles of respective lines connecting ends of the frame mutually opposed in the second direction, respectively.

The present invention includes preferred embodiments as follow.

The frame further includes first and second support members dimensioned to be shorter than the first and second space defining members supported by the support members, the first and second support members extending in the second direction in parallel to and spaced from each other and having a mechanism adapted to adjust a space defined between the first and second space defining members, and the first and second strip-shaped members are placed at respective middles of the first and second support members as viewed in the second direction.

Each of the first and second space defining members includes a hard core and elastic buffer material covering this hard core.

Each of the first and second space defining members has a circular cross-section.

Each of the first and second support members includes a strip-shaped base plate and brackets slidably and detachably put on the support member so as to extend upward at ends of the support member opposed in the second direction and each of the bracket is provided on an inner side thereof with a coupling member operated with an associated one of the ends of the first and second support members opposed in the first direction, respectively.

The coupling member includes a protuberance and the first and second space defining members are provided at least opposite ends thereof as viewed in the first direction with hollow portions adapted to be detachably engaged with the coupling members, respectively.

The bracket is slidable along the base plate in the second direction and detachably engaged with the base plate.

The bracket is formed from an elastic material and has a planar portion overhanging from a lower portion of the bracket in the first direction and having a channel through which the base plate is slidably inserted in the second direction.

Each of the first and second support members has a smooth lower surface.

The mechanism adapted to adjust the space defined between the first and second space defining members comprises a plurality of first locking components provided in the base plate in the vicinity of the ends thereof opposed in the second direction so as to be arranged intermittently in the second direction and a second locking component provided on an elastic section extending from the planar overhanging portion in the second direction so that the second locking component may be selectively engaged with one of the plural first locking components under an elastic pressure of the elastic section.

The first and second strip-shaped members are detachably coupled to the base plates by means of the respective coupling members.

The practice device for corrected golf swing proposed by the present invention is adapted to be used by a player in such a manner that the player tries to swing his or her golf club in alignment with an imaginary line connecting the first and second strip-shaped members and extending along a center line between the first and second space defining members so as to define the target line. If the golf ball strikes against at least one of the first and second space defining members along which the player takes a stance, the player can recognize whether his or her swing has been "inside out" or "outside in" or "cut shot". On the basis of such recognition, the player may repetitively the practice in an effort to cause the golf head to pass exactly along the target line. In this way, it can be achieved to improve skill requirements for the golf player, that is, "on plane swing", "face control" and "linear impact zone."

A beginner may start with the space defined between the first and second space defining members adjusted to the maximum, then practice with the space stepwise narrowed as he or she gradually comes along.

In the case of the embodiment in which the first and second space defining members covered with the elastic buffer material, even when the club head strikes against these members due to incorrect swing, not only the club head but also the frame including these members can be protected against damage.

In the case of the embodiment in which the first and second space defining members can be disassembled not only from each other but also from the first and second support members which can be, in turn, disassembled from each other and the first and second support members can be disassembled not only from each other but also from the first and second strip-shaped members which can be, in turn, disassembled from each other, the practice device can be compactly put in a bag or the like for shipping or carrying.

In the case of the embodiment in which the first and second support members have smooth lower surfaces, if the club head applies a considerably high impact on the inner side of the first and/or second space defining members, the practice device itself will slide on ground surface (or floor surface). Therefore, it is possible for the player to recognize how his or her swing has been incorrect and consequently the club head as well as the frame can be protected against damage.

DETAILED DESCRIPTION OF THE PREFERRED EMBODIMENTS

Figure 1:
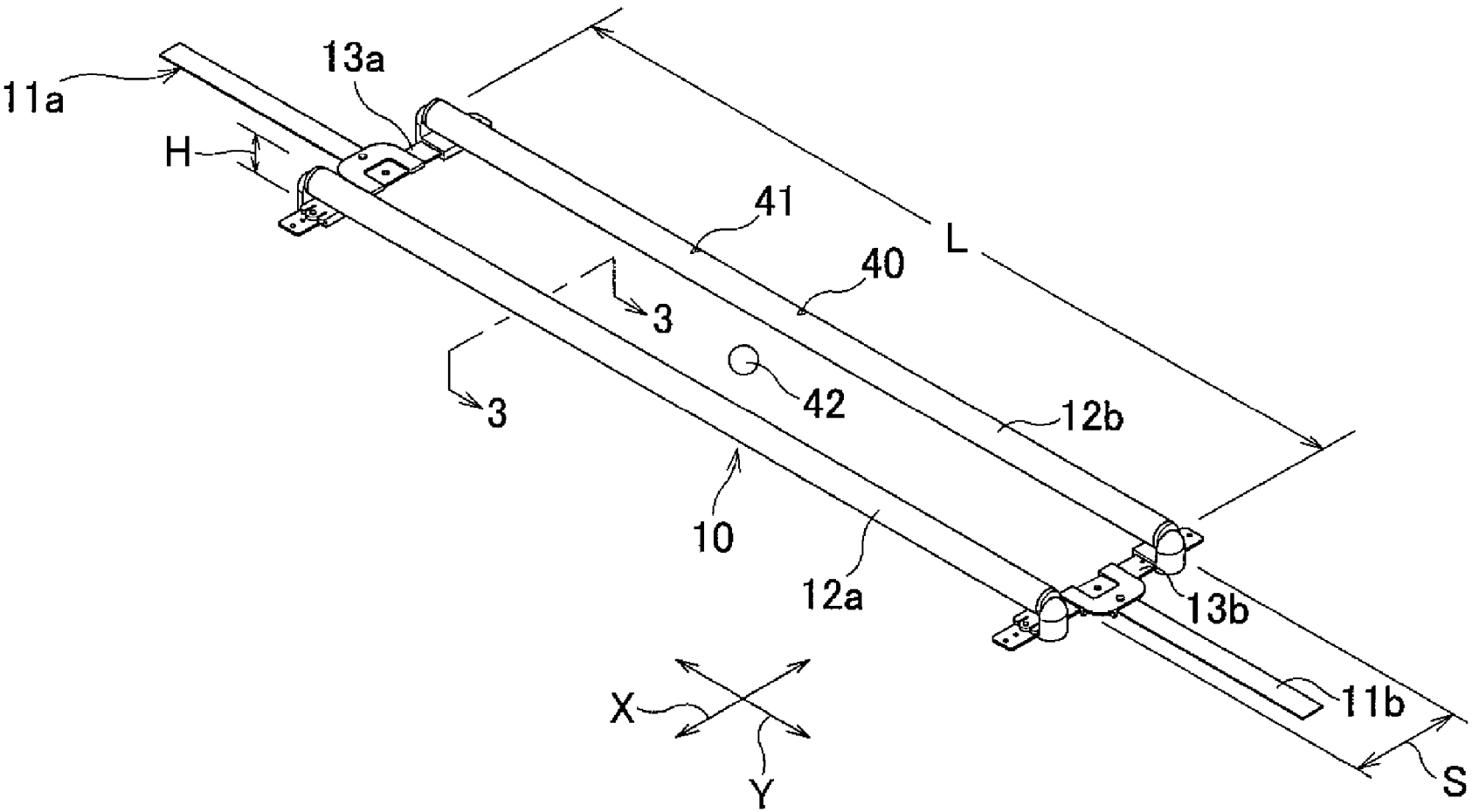
FIG. 1 is a perspective view showing a practice device for corrected golf swing in an assembled state thereof.

Referring to FIG. 1 showing a practice device for corrected golf swing in an assembled state thereof, the practice device has a first direction Y and a second direction X which is orthogonal to the first direction Y. The practice device includes a frame 10 which is relatively long in the first direction Y and first and second strip-shaped members 11*a*, 11*b* aligned with each other to define a straight target line extending in the direction Y.

The frame 10 is relatively long in the first direction Y and has opposite ends in the first direction Y configured symmetrically to each other. The frame 10 comprises first and second space defining members 12*a*, 12*b* extending in the first direction Y in parallel to each other, leaving a space therebetween, and first and second support members 13*a*, 13*b* extending in the second direction Z in parallel to each other, leaving a space therebetween, so as to support the first and second space defining members 12*a*, 12*b* and to adjust a space S between the first and second space defining members 12*a*, 12*b* via a mechanism M as will be described later in detail.

The first and second strip-shaped members 11*a*, 11*b* respectively extend straight in the first direction Y outward from middles of respective lines connecting the ends of the frame 10 which are mutually opposed in the second direction X.

Figure 2:
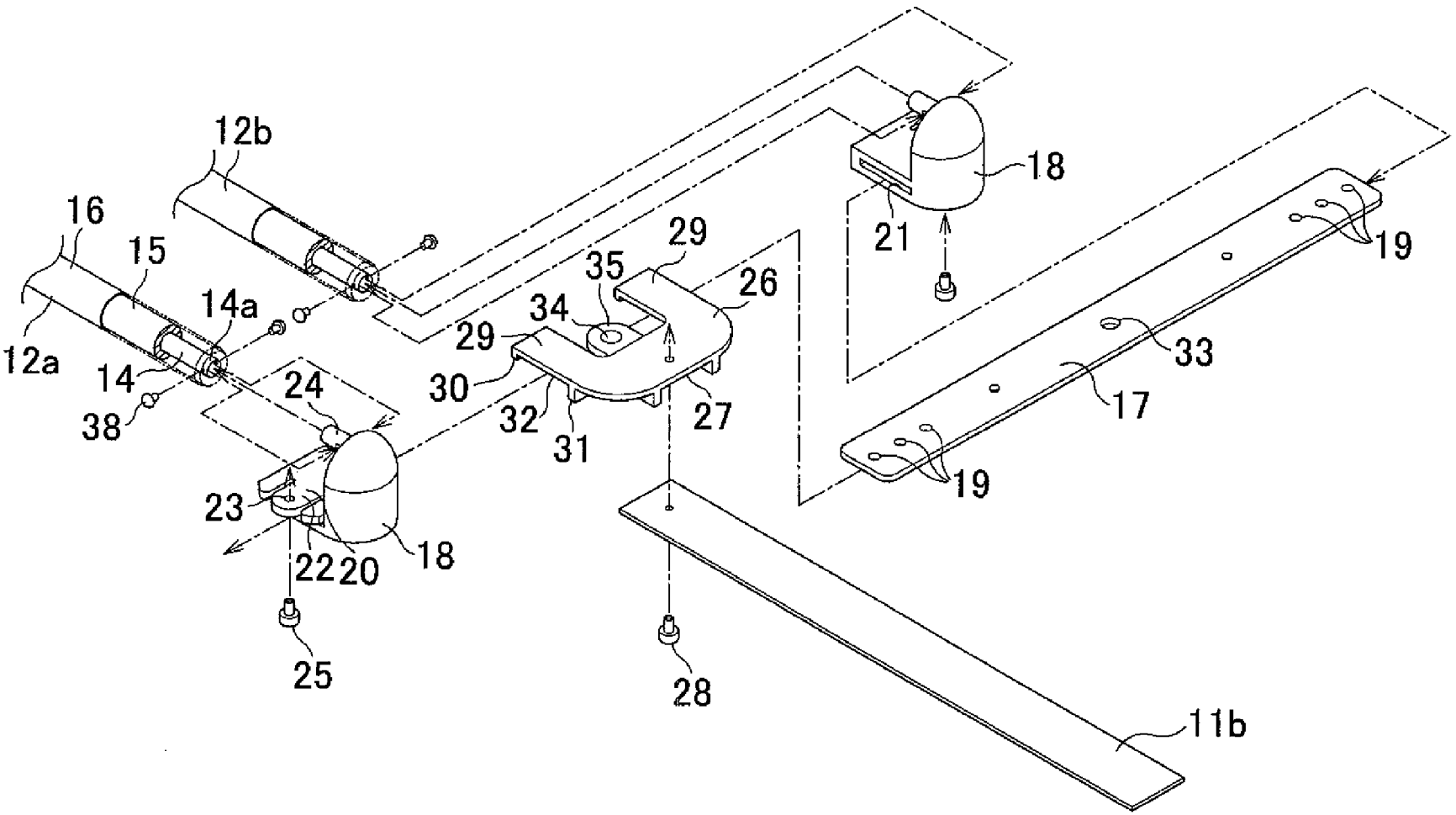
FIG. 2 is an exploded diagram illustrating one end of a frame as viewed in a first direction and a strip-shaped member provided at this one end.
Figure 3:
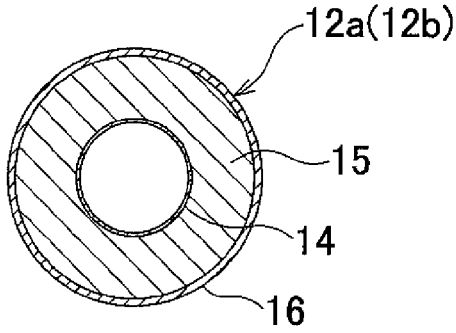
FIG. 3 is a sectional view taken along the line 3-3 in FIG. 1.

Referring to an exploded diagram of FIG. 2 illustrating one end of the frame 10 as viewed in the first direction Y and the strip-shaped member 11*b* at this one end, each of the first and second space defining members 12*a*, 12*b* comprises a tubular core 14 made of a hard material such as metal, an elastic buffer material 15 made of an elastic material such as a sponge rubber covering the core 14 and, optionally, a soft plastic surface material 16 covering the elastic buffer material 15 (See FIG. 3).

Each of the first and second support members 13*a*, 13*b* has ends which are opposite in the second direction X and symmetrical to each other. As will be apparent from FIGS. 1 and 2 showing the one 13*b* of these support members 13*a*, 13*b*, each of the support members 13*a*, 13*b* comprises a metallic hard base plate 17 and a pair of brackets 18 provided in the vicinity of the ends opposed to each other in the second direction X. The base plate 17 has upper and lower surfaces both being smooth and is formed in the vicinity of the end which are opposite in the second direction X with a plurality of first locking components 19 in the form of openings arranged intermittently in the second direction X. The brackets 18 are made of an elastic material such as rubber and formed in the vicinity of upper ends thereof with protrusions 24 extending in the first direction Y from respective inner sides thereof so as to be inserted into ends 14*a*, 14*b* of the respective tubular hard cores 14 opposed to each other in the second direction X as the components of the first and second space defining members 12*a*, 12*b* and then to be fixed thereto via screws 38, planar portions 20 overhanging in the first direction Y from bottoms, channels 21 through which the base plate 17 is guided in the second direction X and elastic locking components 23 each defined by slits 22 spaced from each other and extending outward in the second direction X just above the associated channel 21. The base plates 17 are inserted through the respective pair of channels 21 so as to be slidable in the second direction X.

Figure 4:
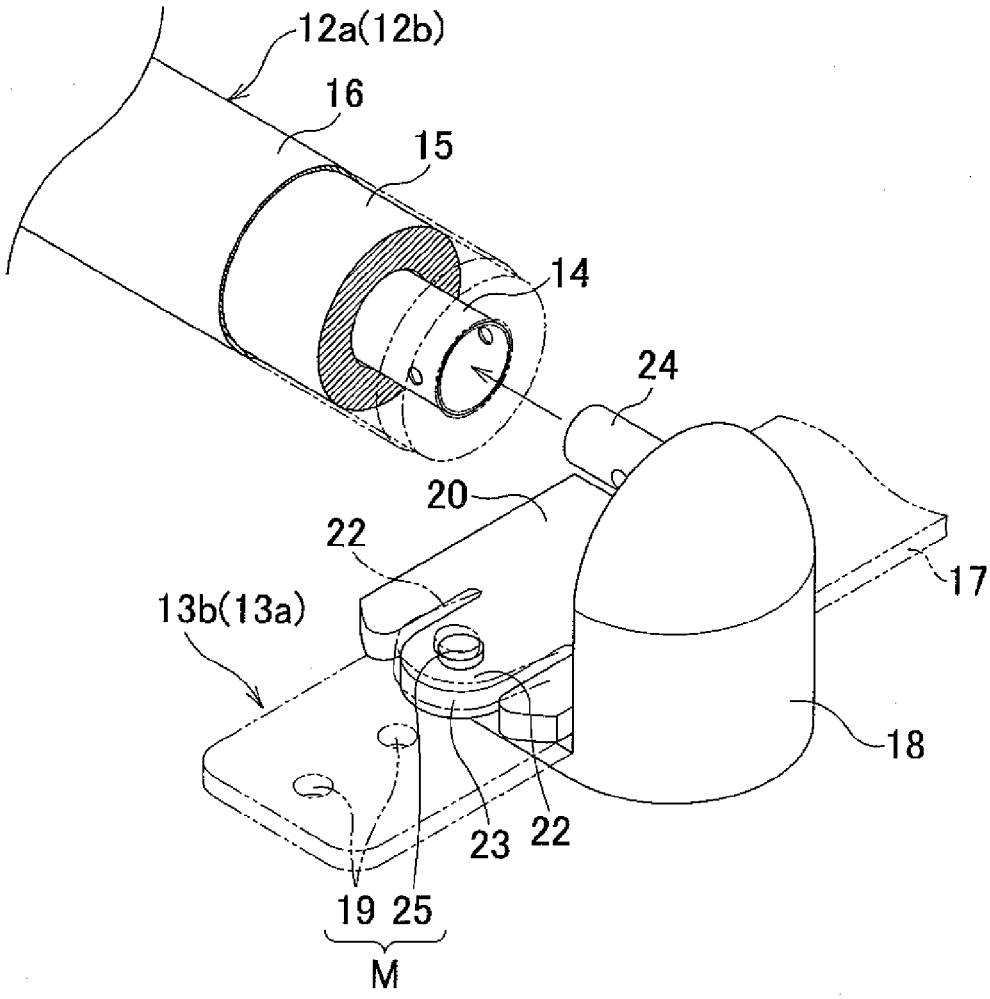
FIG. 4 is an exploded perspective view showing a space defining member and a support member.
Figure 5:
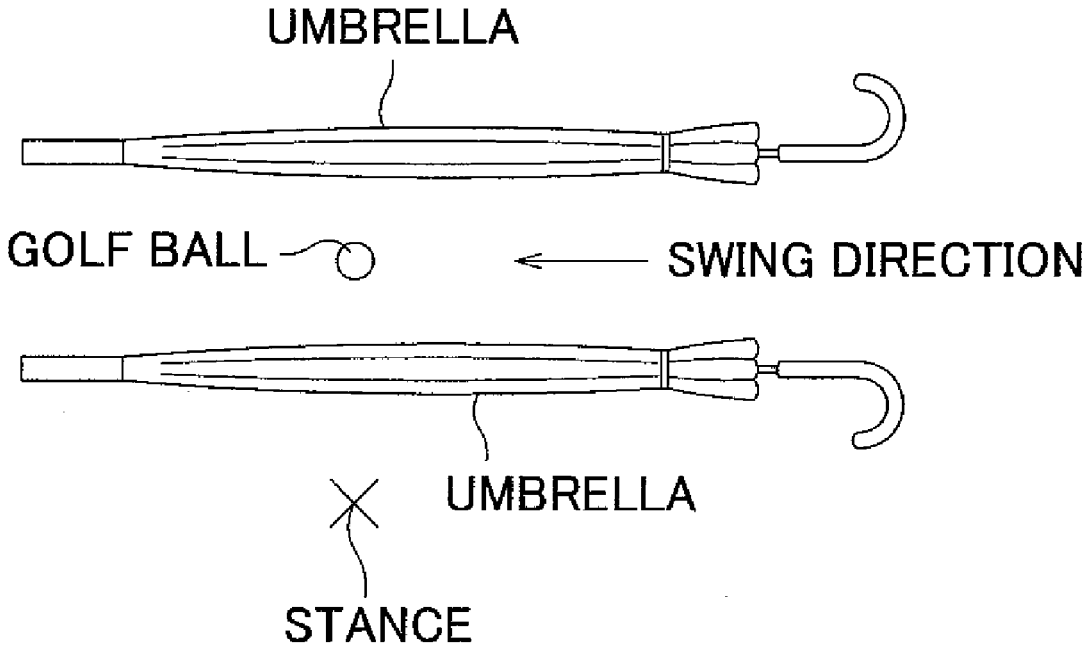
FIG.5 PRIOR ART
FIG. 5 is a perspective view showing prior art.

Referring to FIG. 4 showing the first and second space defining members 12*a*, 12*b* along with the first and second support members 13*a*, 13*b* in an exploded perspective view, each of the elastic locking components 23 is provided on a free end thereof with a second locking component 25 fixed thereto, which is made of a hard metallic material. The second locking component 25 comes in selective engagement with desired one among the plurality of first locking components 19 under elastic pressure of the elastic locking component 23 and as the bracket 18 slidably moves relatively to the base plate 17. Thereby the bracket 18 is fixed to the base plate 17. In this manner, the first and second locking components 19, 25 constitute together the mechanism M serving to adjust the space S between the first and second space defining members 12*a*, 12*b*.

According to the embodiment as illustrated, the position at which the first locking component 19 and the second locking component 25 are engaged with each other can be selected from three positions, i.e., the innermost position, the outermost position and the intermediate position and thereby the space S (See FIG. 1) can be adjusted to three different dimensions of the space S. Specifically, the space S will be adjusted to the maximum dimension, the minimum dimension and the intermediate dimension, respectively, when the position of the engagement is set to the innermost position, the outermost position and the intermediate position, respectively. In practice for a golf swing, a beginner preferably starts with the maximum space, then practices with the intermediate space and finally with the minimum space as he or she gradually comes along.

Referring again to FIG. 2, each of the first and second strip-shaped members 11*a*, 11*b* is inserted into a groove 27 formed in a lower surface of a coupling member 26 along its middle zone and then fixed to the coupling member 26 via a screw 28. The coupling member 26 comprises a pair of coplanar portions 29 overhanging inward relative to the groove 27 in the first direction Y, crooks 30 defined by distal ends of the respective portions 29 bent downward, partitions 31 formed on a lower surface of the respective portions 29 along respective middles thereof as viewed in the first direction Y, an elastic locking piece 35 and a groove 32 defined by the crooks 30, the partitions and the elastic locking piece 35. A free end of the elastic locking piece 35 is provided on its upper surface with a protuberance 34 adapted to be engaged with a locking hole 33 located at a middle of the base plate 17 as viewed in the second direction X.

Referring again to FIG. 1, the space S between the first and second space defining members 12*a*, 12*b* is adjustable by means of the adjusting mechanism M preferably in a range of 140 to 200 mm. Each of the space defining members 12*a*, 12*b* has a length L preferably in a range of 800 to 1,000 mm and a height H preferably 1.0 to 2.0 times a golf ball diameter. The length L less than 800 mm would increase a possibility that a club-head might smash against an apex of the space defining member 12*a* or 12*b* and the length exceeding 1,000 mm would be disadvantageous because such length L is beyond necessity and disadvantageous not only from an economical viewpoint but also from a viewpoint of portability. The space S less than 140 mm would be too restricted for practice for swing with a driver and the space S exceeding 200 mm would be too large to achieve the desired effect of practice for swing. The height less than 1.0 time the golf ball diameter would make it difficult to recognize whether a swing trajectory has been "inside out" or "outside in" and whether a swing has been "cut shot" or not. The height exceeding 2.0 times the golf ball diameter would increase a possibility that the club-head might smash against any one of the first and second space defining members 12*a*, 12*b* even when the player correctly swings.

At least one of the first and second space defining members 12*a*, 12*b* is provided at a middle point thereon in the first direction Y with a first marker 40 and, toward the first support member 13*a* with a second marker 41. Preferably, the player may take a stance on the basis of the first marker 40 for swing practice with an iron club and may set a golf ball 42 on the basis of the second marker 41 for swing practice with a driver.

For reference's sake, the practice device for corrected golf swing according to the present invention constructed as has been described above is useful not only for swing practice with an iron club or a driver but also for approach shot practice with a wedge.

The entire discloses of Japanese Patent application No. 2006-47572 filed on Feb. 23, 2006 including specification, drawings and abstract are herein incorporated by reference in its entirety.

What is claimed is:

1. A practice device for corrected golf swing having a first direction and a second direction orthogonal to said first direction, said practice device comprising:

a frame which is relatively long in said first direction;

first and second strip-shaped members having a length and a width, said lengths of said strip-shaped members being aligned with each other so as to form a target line extending straight in said first direction; and first and second space defining members having lengths which extend in parallel to each other in said first direction, leaving an adjustable space therebetween, wherein the lengths of said first and second strip-shaped members respectively are aligned and extend straight in said first direction outward from middle portions of respective imaginary lines that extend between and connect ends of said frame mutually opposed in said second direction, respectively, said first and second strip-shaped members being at a vertical position that is beneath said first and second space defining members when the practice device is in use.

2. The practice device defined by claim 1, wherein said frame further includes first and second support members dimensioned to be shorter than said first and second space defining members supported by said support members, said first and second support members extending in said second direction in parallel to and spaced from each other and having a mechanism for adjusting a space defined between said first and second space defining members; and said first and second strip-shaped members are placed at respective middles of said first and second support members as viewed in said second direction.

3. The practice device defined by claim 1, wherein each of said first and second space defining members comprises a hard core and an elastic buffer material covering said hard core.

4. The practice device defined by claim 1, wherein each of said first and second space defining members has a circular cross-section.

5. The practice device defined by claim 2, wherein each of said first and second support members comprises a elongated base plate and brackets that are slidably and detachably put on said elongated base plate so as to extend upward at ends of said elongated base plate opposed in said second direction and wherein each of said brackets is provided on an inner side thereof with a coupling member operated with an associated one of the ends of said first and second support members opposed in said first direction, respectively.

6. The practice device defined by claim 5, wherein said coupling member comprises a protuberance and said first and second space defining members are provided at least opposite ends thereof as viewed in said first direction with hollow portions for detachable engagement with said coupling members, respectively.

7. The practice device defined by claim 5, wherein said bracket is slidably coupled along said base plate in said second direction and detachably engaged with said base plate.

8. The practice device defined by claim 5, wherein said bracket is formed from an elastic material and has a planar portion overhanging from a lower portion of said bracket in said first direction and having a channel through which said base plate is slidably inserted in said second direction.

9. The practice device defined by claim 2, wherein each of said first and second support members has a smooth lower surface.

10. The practice device defined by claim 5, wherein said mechanism for adjusting the space defined between said first and second space defining members comprises a plurality of first locking components provided in said base plate in a vicinity of the ends thereof opposed in said second direction so as to be arranged intermittently in said second direction and a second locking component provided on an elastic section extending from said planar overhanging portion in said second direction so that said second locking component is selectively engaged with one of said plural first locking components under an elastic pressure of said elastic section.

11. The practice device defined by claim 5, wherein said first and second strip-shaped members are detachably coupled to said base plates by means of the respective coupling members.

12. The practice device defined by claim 1, wherein each of said first and second space defining members has a length in a range of 800 to 1,000 mm in said first direction.

13. The practice device defined by claim 1, wherein said first and second space defining members define a space in a range of 140 to 200 mm therebetween.

14. The practice device defined by claim 1, wherein said first and second space defining members have a height in a range of 1.0 to 2.0 times a diameter of a golf ball.

* * * * *